US006276770B1

(12) United States Patent
Muller et al.

(10) Patent No.: US 6,276,770 B1
(45) Date of Patent: Aug. 21, 2001

(54) MAILING MACHINE INCLUDING INK JET PRINTING HAVING PRINT HEAD MALFUNCTION DETECTION

(75) Inventors: Arno Muller, Westport, CT (US); Eswaran C. N. Nambudiri, Ryebrook, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/193,610

(22) Filed: Nov. 17, 1998

(51) Int. Cl.[7] ..... B41J 2/01

(52) U.S. Cl. ..... 347/2; 347/19; 347/23

(58) Field of Search ..... 347/2, 3, 6, 7, 347/19, 23, 14, 17, 29, 33; 400/120.01; 358/504, 406

(56) References Cited

U.S. PATENT DOCUMENTS

| | | | | |
|---|---|---|---|---|
| 4,241,406 | | 12/1980 | Kennedy et al. | 364/518 |
| 4,648,048 | | 3/1987 | Dorn et al. | 364/526 |
| 4,900,941 | | 2/1990 | Barton et al. | 250/566 |
| 4,907,013 | | 3/1990 | Hubbard et al. | 346/1.1 |
| 5,038,208 | | 8/1991 | Ichikawa et al. | 358/75 IJ |
| 5,128,691 | | 7/1992 | Millet et al. | 346/1.1 |
| 5,206,668 | * | 4/1993 | Lo et al. | 347/6 |
| 5,224,421 | | 7/1993 | Doherty | 101/211 |
| 5,289,208 | | 2/1994 | Haselby | 346/140 R |
| 5,315,316 | * | 5/1994 | Khormaee | 347/3 |
| 5,321,436 | | 6/1994 | Herbert | 346/140 R |
| 5,473,351 | | 12/1995 | Helterline et al. | 347/19 |
| 5,495,103 | | 2/1996 | Utiger et al. | 250/222.1 |
| 5,587,728 | | 12/1996 | Edgar | 347/19 |
| 5,596,353 | | 1/1997 | Takada et al. | 347/19 |
| 5,650,804 | | 7/1997 | Kawamura et al. | 347/19 |
| 5,736,996 | * | 4/1998 | Takada et al. | 347/19 |
| 5,760,799 | | 6/1998 | Inni et al. | 347/14 |
| 5,764,251 | | 6/1998 | Hashimoto et al. | 347/16 |
| 5,771,051 | | 6/1998 | Guenther et al. | 347/19 |
| 5,781,204 | | 7/1998 | Kanematsu et al. | 347/17 |
| 5,798,772 | | 8/1998 | Tachihara et al. | 347/11 |
| 5,806,994 | * | 9/1998 | Coffy et al. | 400/120.01 |
| 5,933,179 | | 8/1999 | Fogle et al. | 347/188 |
| 5,956,051 | * | 9/1999 | Davies et al. | 347/2 |

FOREIGN PATENT DOCUMENTS

| | | | |
|---|---|---|---|
| 0702334A1 | 8/1995 | (EP) | G07B/17/02 |
| 0702335A1 | 8/1995 | (EP) | G07B/17/02 |
| 0714777B1 | 11/1995 | (EP) | B41J/2/165 |

OTHER PUBLICATIONS

U.S. Patent Applicaiton 08/240,199, filed May 9, 1994, in the names of Fogle, et al., entitled Method of Insuring Print Quality of a Thermal Printer.

* cited by examiner

*Primary Examiner*—John Barlow
*Assistant Examiner*—Craig A. Hallacher
(74) *Attorney, Agent, or Firm*—Alberta A. Vitale; Michael E. Melton

(57) ABSTRACT

A postage printing system, comprising an ink jet printer including a print head for printing a postal indicia on a mailpiece and a control system. The control system is in operative communication with the print head and performs the following: monitoring an initial temperature of the print head; causing the print head to print a test print; monitoring a subsequent temperature of the print head after completion of the test print; comparing an actual temperature change, from the initial temperature to the subsequent temperature, within an expected temperature change; and continuing normal operation of the postage printing system if the actual temperature change is with an acceptable range of the expected temperature change.

10 Claims, 5 Drawing Sheets

MAILING MACHINE INCLUDING INK JET PRINTING HAVING PRINT HEAD MALFUNCTION DETECTION

CROSS REFERENCE TO RELATED APPLICATIONS

This application is related to the following co-pending applications filed concurrently herewith and assigned to the assignee of this application: U.S. patent application Ser. No. 09/193,609, entitled APPARATUS AND METHOD FOR REAL-TIME MEASUREMENT OF DIGITAL PRINT QUALITY ; U.S. patent application Ser. No. 09/193,608, entitled APPARATUS AND METHOD FOR REAL-TIME MEASUREMENT OF DIGITAL PRINT QUALITY; and U.S. patent application Ser. No. 09/193,607, entitled APPARATUS AND METHOD FOR MONITORING OPERATION OF AN INK JET PRINTHEAD; all of which are specifically incorporated herein by reference.

FIELD OF THE INVENTION

This invention relates to ink jet printing. More particularly, this invention is directed to a postage printing apparatus including an ink jet printer having an ink jet cartridge wherein the postage printing apparatus performs a diagnostic routine to determine the operational status of the ink jet cartridge.

BACKGROUND OF THE INVENTION

Ink jet printers are well known in the art. Generally, an ink jet printer includes an array of nozzles or orifices, a supply of ink, a network of channels connecting the array of nozzles with the ink supply, a plurality of ejection elements (typically either expanding vapor bubble elements or piezoelectric transducer elements) corresponding to the array of nozzles and suitable driver electronics for controlling the ejection elements. Typically, the array of nozzles and the ejection elements along with their associated components are referred to as a print head. It is the activation of the ejection elements which causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed or the current ink cartridge has malfunctioned. However, in either case, the printer continues to operate with the result being that the user must recognize when the print quality degrades to an unacceptable level and install a fresh cartridge. Thus, it is generally intended for the cartridges to be disposable.

Recently, the postage meter industry and other envelope printing industries have begun to incorporate ink jet printers. A typical postage meter (one example of a postage printing system) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Since postal services accept postal indicia printed by postage printing systems as conclusive proof of payment of the amount of postage indicated, such devices are in effect machines for printing money. As a result, postal authorities that oversee operation of the postage printing systems impose high standards both on the print quality of postal indicia produced by such machines, and on the design of the machines themselves to assure that the appropriate amount is debited corresponding to the amount of postage indicated for each postal indicia.

With the incorporation of ink jet printing, postage printing devices now face the same problems associated with the use of ink jet cartridges as are found in general purpose ink jet printers. However, new problems also arise due to the inherent nature of printing an indicia of value. For example, if a general purpose ink jet printer runs out of ink while printing a document, then the user merely installs a new cartridge and reprints the document. On the other hand, if a postage printing device runs out of ink while printing a postal indicia, then the user loses money because the postal funds associated with that postal indicia cannot be recovered. As another example, if some of the ejection elements are not operating due to degradation of the ejection elements over time or some other malfunction condition, then the postal indicia will suffer from reduced print quality, even if adequate amounts of ink are present, resulting in a loss of optical character recognition (OCR) readability and loss of sufficient fluorescence necessary to be detected by a facer/canceller apparatus as a valid postal indicia. This will likely result in the mailpiece being returned to the sender by the postal authority. Again, the user loses money because the postal funds associated with that postal indicia cannot be recovered.

Therefore, there is a need for determining when a postage printing system is not in proper working condition. More particularly, there is a need for a postage printing system including an ink jet printer having an ink jet cartridge wherein the postage printing system performs a diagnostic routine to determine the operational status of the ink jet cartridge. In this manner, the user does not suffer a loss of funds by continuing to operate the postage printing system with a dysfunctional ink jet cartridge.

SUMMARY OF THE INVENTION

The present invention provides a system and method for determining the operational status of a print head. The operational status of the print head is determined at previously defined intervals which are selected to limit the risk of loss of postal funds.

In accordance with the present invention, there is provided postage printing system comprising an ink jet printer including a print head for printing a postal indicia on a mailpiece and a control system. The control system is in operative communication with the print head and performs the following: monitoring an initial temperature of the print head; causing the print head to print a test print; monitoring a subsequent temperature of the print head after completion of the test print; comparing an actual temperature change, from the initial temperature to the subsequent temperature, within an expected temperature change; and continuing normal operation of the postage printing system if the actual temperature change is within an acceptable range of the expected temperature change.

In accordance with the present invention, a method of operating a postage printing system and a method of manufacturing a postage printing system are also provided.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Postage meter mailing machines, one example of a postage printing system, are well known in the art. Generally, postage meter mailing machines are readily available from manufacturers such as Pitney Bowes Inc. of Stamford, CT. Postage meter mailing machines often include a variety of different modules which automate the processes of producing mailpieces. The typical postage meter mailing machine includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying evidence of postage, accounting for postage used and stacking finished mailpieces. However, the exact configuration of each postage meter mailing machine is particular to the needs of the user. Customarily, the postage meter mailing machine also includes a transport apparatus which feeds the mailpieces in a path of travel through the successive modules of the postage meter mailing machine.

Figure 1:
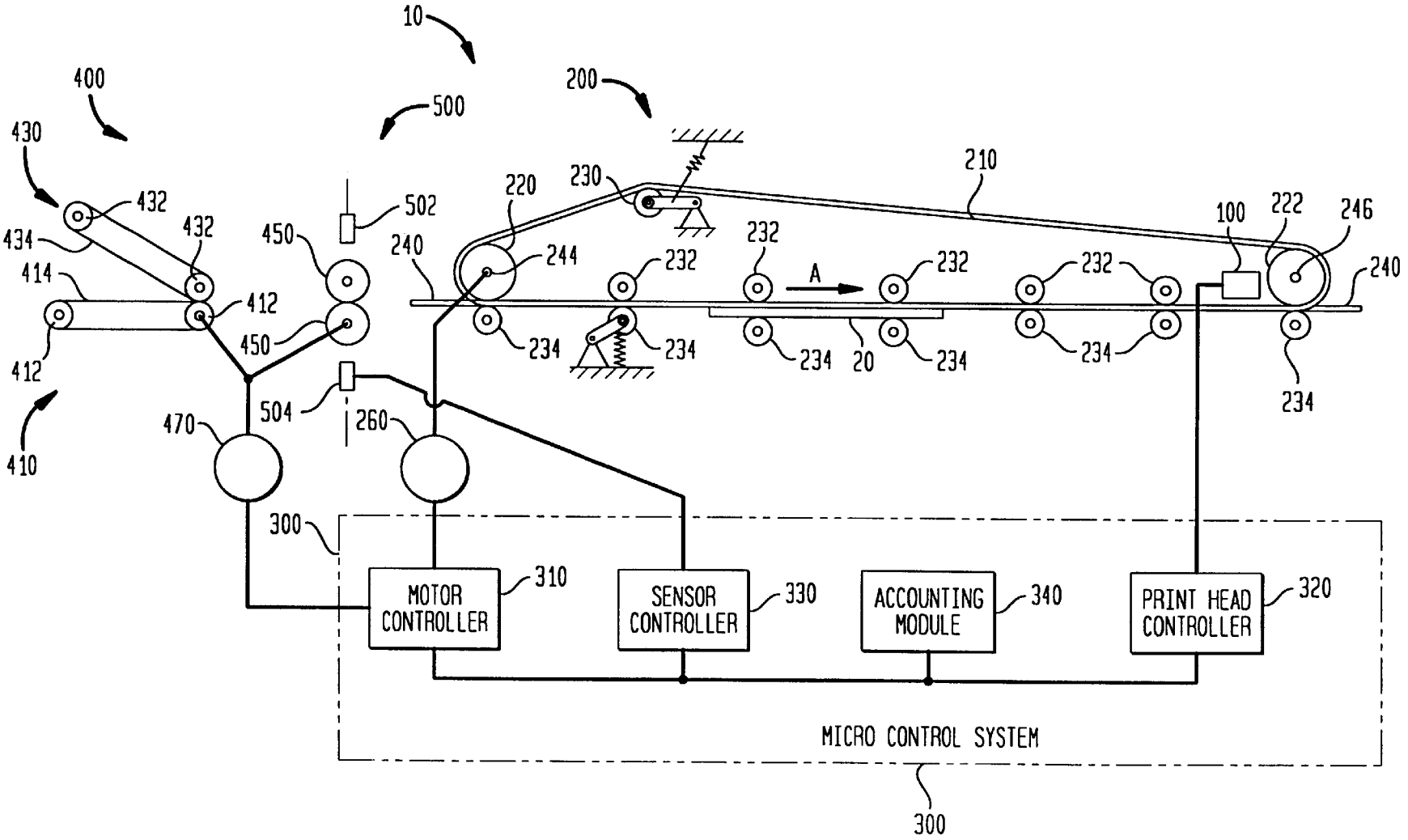
FIG. 1 is a simplified schematic of a front elevational view of a postage meter mailing machine which incorporates the present invention.

Referring to FIG. 1, an example of a postage meter mailing machine 10 in which the present invention may be incorporated is shown. The postage meter mailing machine 10 includes a printer module 100, a conveyor apparatus 200, a micro control system 300 and a singulator module 400. Other modules of the postage meter mailing machine 10, such as those described above, have not been shown for the sake of clarity. Furthermore, a concise explanation of the postage meter mailing machine 10 will be provided as necessary to provide an understanding of the present invention.

The singulator module 400 receives a stack of envelopes (not shown), or other mailpieces such as postcards, folders and the like, and separates and feeds them in a seriatim fashion (one at a time) in a path of travel as indicated by arrow A. Downstream from the path of travel, the conveyor apparatus 200 feeds the envelopes 20 in the path of travel along a deck 240 past the printer module 100 so that a postal indicia (not shown) can be printed through the various modules of the postage meter mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410. Since the details of the singulator module 400 are not necessary for an understanding of the present invention, no further description will be provided.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The postage meter mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector 504 are located in opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck 240. This is commonly referred to as top surface registration which is beneficial for ink jet printing. Any variation in thickness of the envelope 20 is taken up by the deflection of the normal force rollers 234. Thus, a constant space (the distance between the printer module 100 and the deck 240) is set between the envelope 20 and the printer module 100 no matter what the thickness of the envelope 20. The constant space is optimally set to a desired value to achieve quality printing. It is important to note that the deck 240 contains suitable openings (not shown) for the endless belt 210 and normal force rollers 234.

Figure 2:
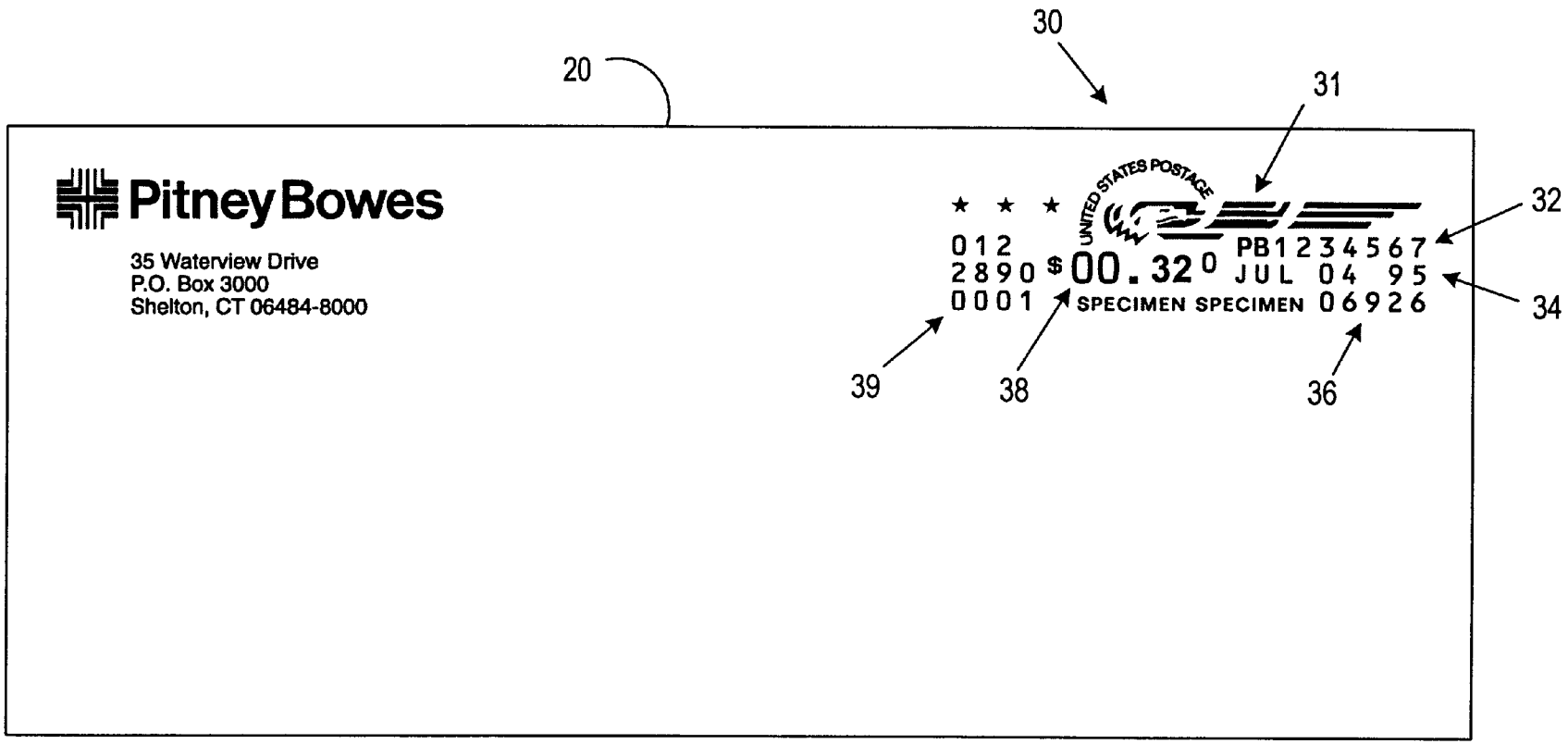
FIG. 2 is a front view of an envelope that has been processed by the postage meter mailing machine.

Referring to FIG. 2, the envelope 20 having the postal indicia 30 printed thereon is shown. The postal indicia 30 includes both fixed data that does not change from postal indicia to postal indicia and variable data that may change from postal indicia to postal indicia. Generally, the fixed data includes a graphic design 31 (an eagle with stars), a meter serial number 32 uniquely identifying the postage meter (not shown) and a licensing post office identifier (zip code) 36. Generally, the variable data includes a date 34 indicating when the postage was dispensed, a postal value 38 indicating an amount of postage and other data 39 for use by the postal authority for verifying the authenticity of the postal indicia 30 using conventional techniques. However, those skilled in the art will recognize that the exact content of both the fixed data and variable data is subject to regulation of the postal authority and a matter of design choice.

Figure 3:
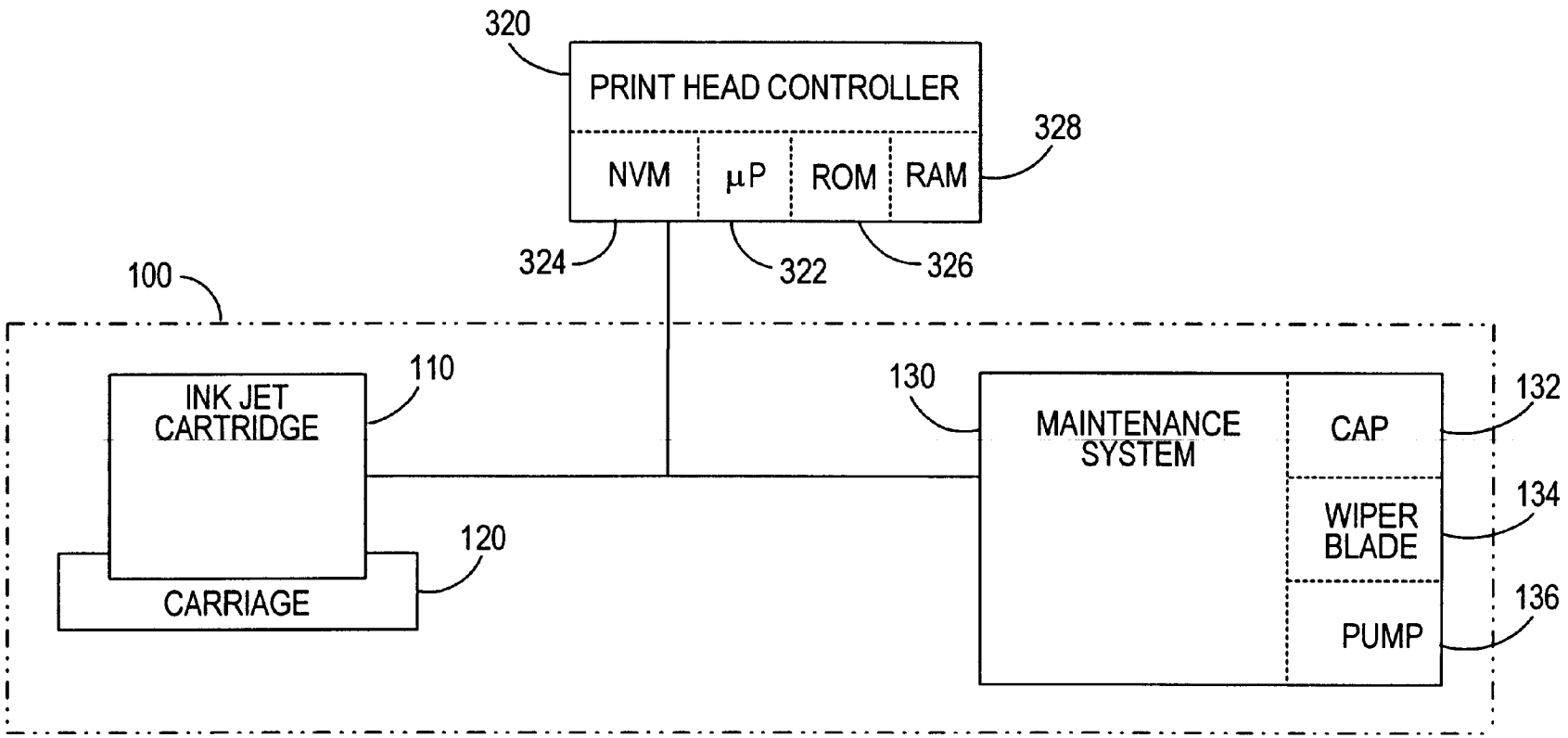
FIG. 3 is a simplified representation of a printer module and a print head controller in accordance with the present invention.

Referring to FIG. 3, a more detailed schematic representation of the printer module 100 and the print head controller 320 is shown. The printer module 100 includes a carriage 120, an ink jet cartridge 110 detachably mounted to the carriage 120 in any conventional fashion and a maintenance system 130. Generally, the maintenance system 130 performs a variety of maintenance operations on the ink jet cartridge 110 to keep the ink jet cartridge 110 in proper working condition. Any conventional system (not shown) for repositioning the carriage 120 and the maintenance system 130 into and out of operative engagement may be employed. The maintenance system 130 includes a cap 132, a wiper blade 134 and a pump 136. The printer module 100 further includes suitable framework (not shown) for supporting the various components of the printer module 100.

To keep the ink jet cartridge 110 in proper working order, a variety of maintenance actions, such as capping, wiping, normal flushing, power flushing, normal purging and power purging, have been developed. Most of these maintenance actions are directed toward preventing the array of nozzles (not shown) from becoming clogged with stale ink or other debris. When not in use, the ink jet cartridge 110 is sealed off from ambient air by the cap 132. In this manner, the evaporation rate of any solvents or other volatiles contained within the ink (not shown) is reduced and the ink is less prone to clumping. The wiper blade 134 is typically employed to squeegee any excess ink or other debris off from the face plate (not shown) of the array of nozzles (not shown). This cleaning action is typically performed both prior to capping and prior to printing. A normal flush involves firing each nozzle in the array of nozzles a predetermined number or times to expel ink that may be beginning to clump. A power flush is similar to a normal flush except that the number of time each nozzle is fired is substantially greater than that for a normal flush. A normal purge involves using the pump 136 to apply a vacuum for a predetermined amount of time to the array of nozzles to suck out ink. A power purge is similar to a normal purge except that the amount of time that the vacuum is applied is substantially greater than that for the normal purge.

The print head controller 320 includes a microprocessor 322, a non-volatile memory (NVM) 324, a read only memory (ROM) 326 and a read access memory (RAM) 328. The ROM 326 stores various operating software programs executed by the microprocessor 322 when placed into RAM 328. The NVM 324 stores various other data, described in more detail below, that is accessed by the operating software programs.

Figure 4:
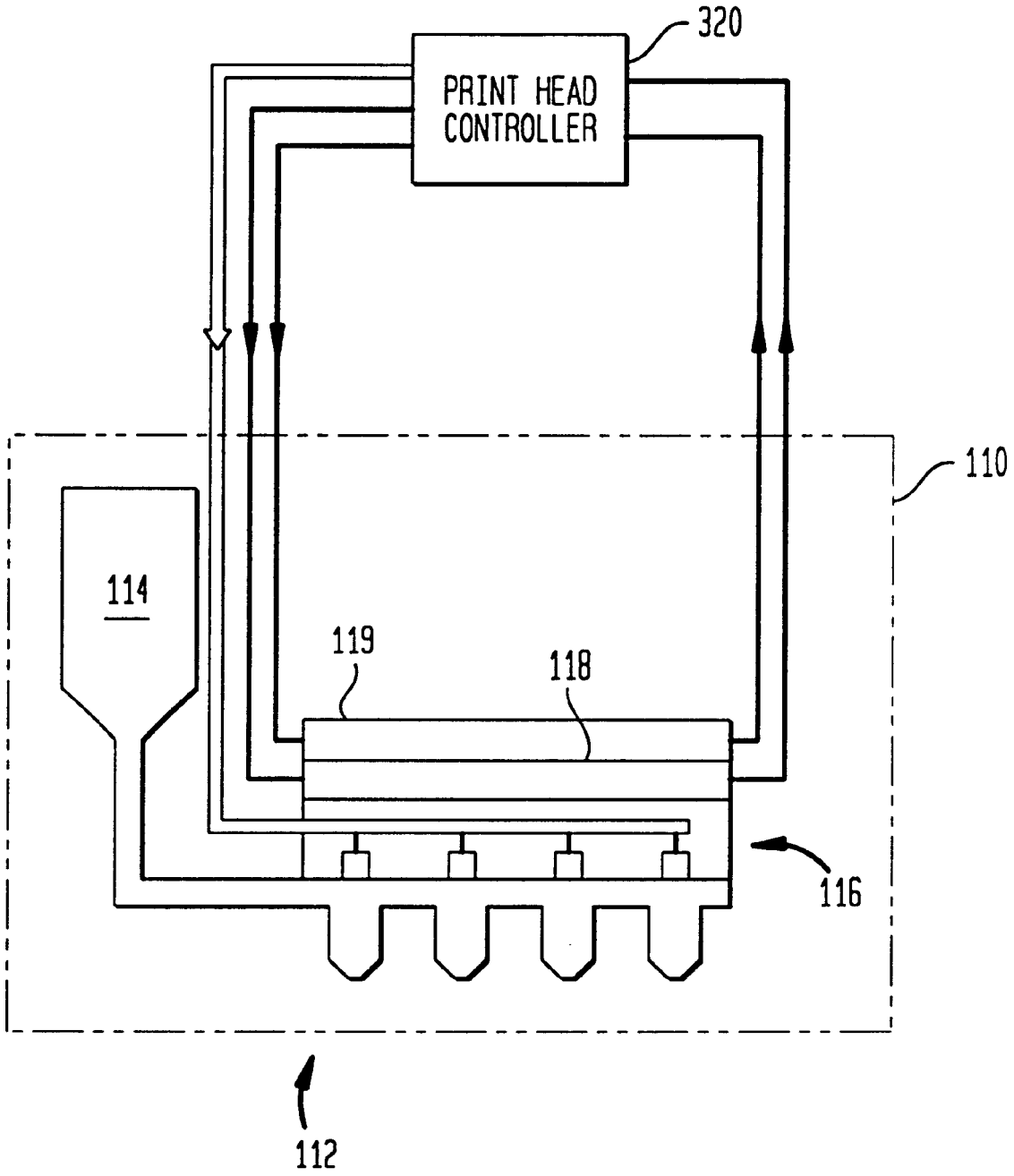
FIG. 4 is a more detailed representation of an ink jet cartridge in accordance with the present invention.

Referring to FIG. 4, a more detailed view of the ink jet cartridge 110 is shown. The ink jet cartridge 110 includes an array of nozzles 112, a supply of ink 114 and a plurality of ejection elements 116 connecting the array of nozzles 112 with ink supply 114, respectively. Activation of each of the ejection elements 116 is selectively controlled by suitable drive signals provided by the print head controller 320 which cause ink 114 to be expelled from the array of nozzles 112 in a predetermined manner. In the preferred embodiment, the plurality of ejection elements 116 are bubble jet type elements. Typically, the array of nozzles 112 and the ejection elements 116 are collectively referred to as a print head.

The ink jet cartridge 110 further includes feed back devices in the form of a diode or diode chain 118 and a resistor 119 which provide calibration information to the print head controller 320 as to the operating conditions of the cartridge 110. Since the diode 118 has a known operating behavior with respect to temperature, by applying a constant current to the diode 118 and measuring the corresponding voltage drop, the print head controller 320 can calculate the ambient temperature of the print head. In similar fashion, by applying a constant current to the resistor 119 and measuring the corresponding voltage drop, the print head controller 320 can calculate the sensitivity of the resistor 119 (sometimes referred to as a rank resistor). Both the ambient temperature and the resistor sensitivity are calibration inputs which are used to optimize the drive signals supplied to the ejection elements 116 to produce quality printed images. In the most preferred embodiment, there are two diodes 118 and one resistor 119 mounted directly to the silicone substrate which comprises the ejection elements 116. Those skilled in the art will recognize that each one of the ejection elements 116 could have its own diode and resistor or that the ejection elements 116 could be grouped into functional blocks with each block having its own diode and resistor.

Referring to FIG. 1, the singulator module 400, conveyor apparatus 200 and the printer module 100, as described above, are under the control of the micro control system 300 which may be of any suitable combination of microprocessors, firmware and software. The micro control system 300 includes a motor controller 310 which is in operative communication with the motors 260 and 470, a print head controller 320 which is in operative communication with the printer module 100, a sensor controller 330 which is in operative communication with the sensor module 500 and an accounting module 340 for authorizing and accounting for the dispensing of postal funds. The motor controller 310, the print head controller 320, the sensor controller 330, the accounting module 340 and other various components of the micro control system 300 are all in operative communication with each other over suitable communication lines.

Figure 5:
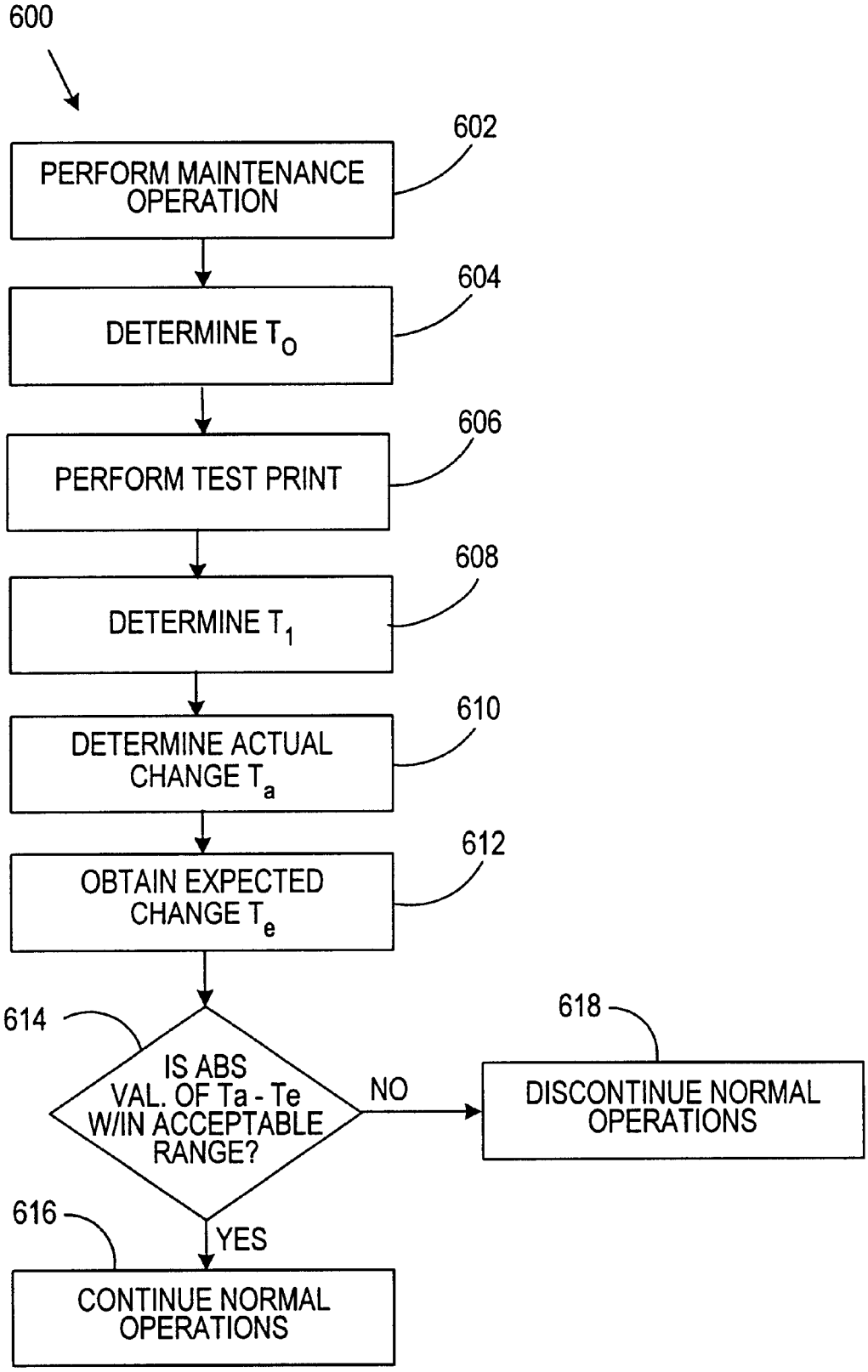
FIG. 5 is a flow chart showing the operation of the postage meter mailing machine in accordance with the present invention.

With the structure of the postage meter mailing machine 10 described as above, the operational characteristics will now be described. Referring primarily to FIG. 5 while referencing the structure of FIGS. 1, 2, 3 and 4, a flow chart of a diagnostic routine 600 performed by the postage meter mailing machine 10 in accordance with the present invention is shown. The diagnostic routine 600 is stored in the ROM 326 and transferred to the RAM 328 for execution by the microprocessor 322. Generally, the diagnostic routine 600 is performed during system initialization at power-up of the postage meter mailing machine 10. However, the diagnostic routine 600 may be performed at other predetermined events, such as: at the beginning of a batch run, after a predetermined number of print cycles during a batch run or some other interval.

At 602, a maintenance operation involving one or more of the maintenance actions described above is performed. The maintenance operation is intended to free any clogged nozzles 112 by removing stale ink from the print head. At 604, an initial temperature $T_0$ of the print head is determined according to the technique described above or some other conventional technique such as by using a temperature sensor within the print head. By preferably obtaining the initial temperature $T_0$ of the print head after the maintenance operation, it is anticipated that the print head should be in proper working condition. Thus, for considerations described in greater detail below, a proper baseline is established because it is difficult to ascertain exactly when during the maintenance operation the print head began functioning properly. At 606, a test print is conducted where the plurality of ejection elements 116 are instructed to expel ink in a predetermined pattern. Preferably, the test print is performed at the maintenance system 130 so that no hard copy print is actually made. This saves time in not having to reposition the carriage 120 and saves paper. Alternatively, the test print may be performed on a blank envelope. At 608, a subsequent temperature $T_1$ of the print head is determined. Generally, it is anticipated that the temperature of the print head will increase following the test print because activation of the plurality of ejection elements 116 produces heat as a direct effect (bubble jet) or as a byproduct (piezoelectric).

Empirical testing revealed that the internal temperature rise of the print head for a given printing operation is greater when the print head does not eject ink than when the print head does eject ink. This is primarily due to two reasons. First, the ink absorbs thermal energy from the print head and carries it away from the print head as the ink is expelled. Second, the ink from the ink supply 114 is typically at a lower temperature than the print head so that, as ink in the print head is expelled, the replenishing ink from the supply 114 has a cooling effect on the print head. When the ink jet cartridge 110 runs out of ink or when the ink clogs in the print head so that ink is not expelled, the cooling effects described above do not occur. Thus, the heat produced by the plurality of ejection elements 116 does not dissipate as readily as when the print head is functioning properly.

On the other hand, empirical testing revealed that the internal temperature rise of the print head for a given printing operation is less when the print head does not eject ink due to failure of the plurality of ejection elements 116 than when the print head does eject ink. This is because the plurality of ejection elements 116 do not produce any heat once they cease to function.

At 610, an actual temperature change $T_a$ of the print head due to printing the test print is determined by subtracting the initial temperature $T_0$ from the subsequent $T_1$. At 612, an expected (anticipated) temperature change $T_e$ of the print head due to printing the test print is obtained from Table 1 which is developed from empirical testing and is stored in the NVM 324. Table 1 includes a series of initial temperatures $T_0^1$ to $T_0^n$ distributed over the operating temperature range of the print head, a corresponding series of respective expected temperature changes $T_e^1$ to $T_e^n$ and a corresponding series of respective acceptable temperature deviations $T_d^1$ to

TABLE 1

| Initial Temp. $T_0$ | Expected Temp. Change $T_e$ | Acceptable Temp. Dev. $T_d$ |
|---|---|---|
| $T_0^1$ | $T_e^1$ | $T_d^1$ |
| $T_0^2$ | $T_e^2$ | $T_d^2$ |
| $T_0^3$ | $T_e^3$ | $T_d^3$ |
| . . . | . . . | . . . |
| $T_0^n$ | $T_e^n$ | $T_d^n$ |

$T_d^n$. Preferably, the acceptable temperature deviations $T_d^1$ to $T_d^n$ are established to be sufficiently small to provide assurance that if the actual temperature change $T_a$ is within plus or minus the respective acceptable temperature deviation $T_d$ from the expected temperature change $T_e$, then the ink jet cartridge 110 is functioning properly.

Stated another way, for each initial temperature $T_0$, there exists a respective expected temperature change $T_e$ and a respective acceptable temperature deviation $T_d^1$. This is because the amount of temperature rise of the print head due to printing the test print is partly dependent upon the initial starting temperature. The number n of partitions of the operating temperature range of the print head is defined by the level of resolution desired. Those skilled in the art will recognize that the actual values for Table 1 depend upon the exact design details of the print head, type of ink being used and the test print being employed. Therefore, exact numbers are not necessary for an understanding of the present invention.

At 614, a determination is made whether or not the absolute value of the difference between the actual temperature change $T_a$ and the expected temperature change $T_e$ is within an acceptable range. That is, expressed as an equation, the following determination is made: $|T_a - T_e| <$ or $= T_d$. If the answer is yes, then at 616, normal operations, such as: printing of postal indicia, printing of reports and the like, are enabled. On the other hand, if at 614 the answer is no, then at 618, normal operations are not enabled due to the risk of loss of postal funds resulting from unacceptable print quality due to an out of ink condition or other malfunction. Optionally, after 618, the operator may be prompted to inspect the ink jet cartridge 110, further maintenance actions may be performed and then routine 600 repeated, and/or an actual test print may be performed such as the one described in U.S. patent application Ser. No. 046,902 filed on Mar. 24, 1998 and entitled MAILING MACHINE INCLUDING PREVENTION OF LOSS OF POSTAL FUNDS the disclosure of which is specifically incorporated herein by reference.

In addition to or as an alternative to the diagnostic routine 600 described above, an analogous diagnostic routine may be employed where the postal indicia 30 is considered to be the test print. Since the postal indicia 30 is very consistent between successive envelopes 20 and generates highly regular print data signals at the print head, it may serve as the test print. That is, the high fixed data content in combination with the fixed format of the variable data yield postal indicias 30 that are predictable and uniform with respect to their thermal effects on the print head. Thus, in contrast to the diagnostic routine 600, the analogous diagnostic routine may be employed real time. Those skilled in the art will recognize that the maintenance operation from the diagnostic routine 600 need not be employed in the analogous diagnostic routine. To further promote operational efficiency, if both the diagnostic routine 600 and the analogous routine are employed, then the test print may be designed to be representative (same thermal loading characteristics) of the postal indicia 30 so that only one table is necessary for both routines.

Base on the above description and the associated drawings, it should now be apparent that the present invention insures: maintenance of high print quality, OCR readability and prevention of loss of postal funds.

Many features of the preferred embodiment represent design choices selected to best exploit the inventive concept as implemented in a postage meter mailing machine employing replaceable ink jet cartridges. However, those skilled in the art will recognize that various modifications can be made without departing from the spirit of the present invention. For example, the inventive concepts of the present invention apply equally well to those configurations where the print head is physically separated from the ink supply, such as when the print head is intended to be permanent or semi-permanent and an off axis ink supply is used. As another example, the table shown and described above may be replaced by a suitable algorithm that calculates the expected temperature change $T_e$ from the initial temperature $T_0$ where the algorithm is designed to mimic the matrix results of the empirical testing.

Therefore, the inventive concept in its broader aspects is not limited to the specific details of the preferred embodiments but is defined by the appended claims and their equivalents.

What is claimed is:

1. A postage printing system, comprising:

an ink jet printer including a print head for printing a postal indicia on a mailpiece;

a control system in operative communication with the print head for:

monitoring an initial temperature of the print head;

causing the print head to print a test print;

monitoring a subsequent temperature of the print head after completion of the test print;

determining an actual temperature change using the initial temperature and the subsequent temperature;

comparing the actual temperature change within an expected temperature change; and continuing normal operation of the postage printing system if the actual temperature change is within an acceptable range of the expected temperature change;

wherein the ink jet printer further includes a maintenance system in selective operative engagement with the print head; and the control system performs a maintenance operation on the print head before monitoring the initial temperature of the print head wherein:

the test print is representative of the postal indicia.

2. A postage printing system, comprising:

an ink jet printer including a print head for printing a postal indicia on a mailpiece;

a control system in operative communication with the print head for:

monitoring an initial temperature of the print head;

causing the print head to print a test print;

monitoring a subsequent temperature of the print head after completion of the test print;

determining an actual temperature change using the initial temperature and the subsequent temperature;

comparing the actual temperature change within an expected temperature change; and continuing normal operation of the postage printing system if the actual temperature change is within an acceptable range of the expected temperature change;

wherein the test print is the postal indicia actually printed on the mailpiece.

3. A method of operating a postage printing system including an ink jet printer having a print head for printing a postal indicia on a mailpiece, the method comprising the step(s) of:

monitoring an initial temperature of the print head;

causing the print head to print a test print;

monitoring a subsequent temperature of the print head after completion of the test print;

determining an actual temperature change using the initial temperature and the subsequent temperature;

comparing the actual temperature change within an expected temperature change; and continuing normal operation of the postage printing system if the actual temperature change is within an acceptable range of the expected temperature change; and wherein the ink jet printer further includes a maintenance system in selective operative engagement with the print head; and further comprising the step of performing a maintenance operation on the print head before monitoring the initial temperature of the print head wherein:

the test print is representative of the postal indicia.

4. A method of operating a postage printing system including an ink jet printer having a print head for printing a postal indicia on a mailpiece, the method comprising the step(s) of:

monitoring an initial temperature of the print head;

causing the print head to print a test print;

monitoring a subsequent temperature of the print head after completion of the test print;

determining an actual temperature change using the initial temperature and the subsequent temperature;

comparing the actual temperature change within an expected temperature change; and continuing normal operation of the postage printing system if the actual temperature change is within an acceptable range of the expected temperature change;

using the postal indicia actually printed on the mailpiece as the test print.

5. A method of manufacturing a postage printing system including an ink jet printer having a print head for printing a postal indicia on a mailpiece, the method comprising the step(s) of:

providing a device capable of monitoring an initial temperature of the print head;

establishing a test print to be printed by the print head;

providing a device capable of monitoring a subsequent temperature of the print head after completion of the test print; and providing a control system for:

determining an actual temperature change using the initial temperature and the subsequent temperature;

comparing the actual temperature change within an expected temperature change; and continuing normal operation of the postage printing system if the actual temperature change is within an acceptable range of the expected temperature change;

providing a maintenance system in selective operative engagement with the print head; and wherein the maintenance system is capable of performing a maintenance operation on the print head before the control system monitors the initial temperature of the print head, further comprising the step(s) of:

establishing the test print as representative of the postal indicia.

6. A method of manufacturing a postage printing system including an ink jet printer having a print head for printing a postal indicia on a mailpiece, the method comprising the step(s) of:

providing a device capable of monitoring an initial temperature of the print head;

establishing a test print to be printed by the print head;

providing a device capable of monitoring a subsequent temperature of the print head after completion of the test print; and providing a control system for:

determining an actual temperature change using the initial temperature and the subsequent temperature;

comparing the actual temperature change within an expected temperature change;

continuing normal operation of the postage printing system if the actual temperature change is within an acceptable range of the expected temperature change; and establishing the postal indicia actually printed on the mailpiece as the test print.

7. An ink jet printer control method for malfunction detection during normal printing operation, the method comprising generating a plurality of highly regular print data content signals during normal printing operation;

printing highly regular print data content from the highly regular print data content signals with an ink jet print head;

monitoring a temperature of the print head during the printing of the highly regular print data content;

determining an actual temperature change of the print head during printing of the highly regular print data content;

comparing the actual temperature change to an expected temperature change based on the high level of regularity of the print data content; and continuing normal printing operation if the actual temperature change is within an acceptable range of the expected temperature change.

8. The ink jet printer control method of claim 7 further comprising the step of performing a maintenance operation on the print head before beginning the step of monitoring the temperature of the print head.

9. The ink jet printer control method of claim 7 wherein the step of generating a plurality of highly regular print data content signals further comprises:

combining 1) fixed data with 2) fixed format variable data, to form the highly regular print data content signals.

10. The ink jet printer control method of claim 9 wherein the step of generating a plurality of highly regular data content signals includes using postal indicia data as the highly regular data content.

* * * * *